US008800360B2

(12) United States Patent
Itoh et al.

(10) Patent No.: US 8,800,360 B2
(45) Date of Patent: Aug. 12, 2014

(54) VANE PUMP APPARATUS AND LEAK CHECK SYSTEM HAVING THE SAME

(75) Inventors: Tomohiro Itoh, Takahama (JP); Mitsuyuki Kobayashi, Gamagori (JP); Shinji Sugihara, Mizuho (JP)

(73) Assignee: Denso Corporation, Kariya (JP)

( * ) Notice: Subject to any disclaimer, the term of this patent is extended or adjusted under 35 U.S.C. 154(b) by 383 days.

(21) Appl. No.: 13/210,731

(22) Filed: Aug. 16, 2011

(65) Prior Publication Data

US 2012/0047999 A1 Mar. 1, 2012

(30) Foreign Application Priority Data

Aug. 27, 2010 (JP) ..... 2010-190467

(51) Int. Cl.
*G01M 3/00* (2006.01)
*F04B 49/06* (2006.01)

(52) U.S. Cl.
USPC ..... 73/168; 73/40

(58) Field of Classification Search
USPC ..... 123/520; 417/44.2; 73/40, 49.2, 49.3, 73/168
See application file for complete search history.

(56) References Cited

U.S. PATENT DOCUMENTS

2006/0016253 A1 1/2006 Kobayashi et al.
2007/0189907 A1 * 8/2007 Kunihiro et al. ..... 417/44.2

FOREIGN PATENT DOCUMENTS

JP 2004-300997 A 10/2004

OTHER PUBLICATIONS

Japanese Office Action dated Aug. 3, 2012, issued in corresponding Japanese Application No. 2010-190467 with English translation.

* cited by examiner

*Primary Examiner* — Daniel S Larkin
(74) *Attorney, Agent, or Firm* — Nixon & Vanderhye P.C.

(57) ABSTRACT

An ECU determines whether condensed water is present at a rotor and vanes based on an electric current, which flows in an electric motor that drives the rotor. When the condensed water is determined to be present, the ECU drives the motor for a predetermined time period. When the condensed water is determined to be absent, the ECU stores a pressure, which is sensed through a pressure sensor, as a first pressure. The ECU is adapted to sense an abnormality in a pump characteristic based on a value of the first pressure.

12 Claims, 7 Drawing Sheets

LEAK CHECK
RESET MEASUREMENT TIME : t=0
S101
DRIVE PUMP
S102
MEASURE MOTOR CURRENT VALUE
S103
S104
CHANGE RATE IN NORMAL RANGE?
NO
YES
S201
SENSE SECOND PRESSURE P2
S202
P2 > UPPER LIMIT?
YES
NO
SENSE FIRST PRESSURE P1
S105
S106
P1 IN NORMAL RANGE?
NO
YES
S111
t ≥ T?
NO
YES
TURN ON CHANGE VALVE
S107
S108
CHECK LEAK PRESSURE
S112
CANCEL LEAK CHECK
END

VANE PUMP APPARATUS AND LEAK CHECK SYSTEM HAVING THE SAME

CROSS REFERENCE TO RELATED APPLICATION

This application is based on and incorporates herein by reference Japanese Patent Application No. 2010-190467 filed on Aug. 27, 2010.

BACKGROUND OF THE INVENTION

1. Field of the Invention

The present invention relates to a vane pump apparatus and a leak check system having the same.

2. Description of Related Art

For instance, Japanese Unexamined Patent Publication No. 2007-218161A (corresponding to US20070189907A1) teaches a leak check system that executes leak check of an evaporative emission system, which is adapted to purge fuel vapor generated in a fuel tank into an intake passage of an internal combustion engine, based on a pressure that is sensed at the time of depressurizing or pressurizing the evaporative emission system by a pump. In this leak check system, a vane pump is used as the pump, which depressurizes or pressurizes a gas. In the vane pump, a rotor is eccentrically received in a housing, and vanes are slidably received in the rotor in a manner that enables radial reciprocation of the vanes relative to the rotor. In this type of vane rotor, when moisture is condensed to water at the rotor and the vanes, the condensed water may possibly cause the vanes to stick to the rotor. In this state, even when the rotor is rotated by an electric motor, the vanes cannot be airtightly slid along an inner peripheral wall of the housing, so that the gas cannot be sufficiently depressurized or pressurized by the vane pump.

In the leak check system of Japanese Unexamined Patent Publication No. 2007-218161A (corresponding to US20070189907A1), prior to the execution of the leak check, the vane pump is driven to depressurize or pressurizes the gas, and a pressure of the depressurized or pressurized gas is sensed. At this time, in a case where the sensed pressure deviates from a normal range on the atmospheric pressure side, and a value of an electric current of the motor is larger than a normal range, it is determined that an abnormality of sticking of the vanes to the rotor occurs due to, for example, the presence of the condensed water. Then, the motor is driven in a manner that eliminates the condensed water, which causes the sticking of the vanes to the rotor.

When abrasion powder, which is generated from the rotor, the vanes and the housing, is accumulated in the housing, a degree of sealing of the housing may possibly be improved. In such a state where the degree of sealing of the housing is improved by the abrasion powder, the sensed pressure may possibly fall in the normal range even in the presence of the condensed water at the rotor and the vanes. In the leak check system of Japanese Unexamined Patent Publication No. 2007-218161A (corresponding to US20070189907A1), the pressure measured at the time of depressurization or pressurization is compared with the normal range thereof before the comparison of the current value of the motor with the normal range thereof. Therefore, the presence of the condensed water, which results in the falling of the sensed pressure within the normal range, cannot be sensed. Thus, when the condensed water is eliminated during the leak check while the abrasion power is kept held in the housing, an erroneous determination of the normality (absence of the leak) may possibly occur even though the leak actually exists.

Japanese Patent No. 421496582 (corresponding to US2006/0016253A1) teaches leak check, which is executed while the electric motor is rotated at a stored rotational speed, which has been stored in a memory and at which a pressure sensed at the time of depressurizing or pressurizing with the vane pump becomes a reference pressure. In this leak check system, in the case where the degree of sealing is improved by the accumulation of the abrasion powder during the leak check, when the motor is rotated at the stored rotational speed, an erroneous determination of the normality (absence of the leak) may possibly occur even though the leak actually exists like in the case of the leak check system of Japanese Unexamined Patent Publication No. 2007-218161A (corresponding to US20070189907A1).

SUMMARY OF THE INVENTION

The present invention addresses the above disadvantages. According to the present invention, there is provided a vane pump apparatus, which is adapted to depressurize or pressurize gas. The vane pump apparatus includes a housing, a rotor, an electric motor, at least one vane, a pressure sensor and means (hereinafter also simply referred to as controlling means) for controlling rotation of the electric motor. The rotor is rotatably received in and is eccentric to the housing. The electric motor drives the rotor upon energization of the electric motor. The at least one vane is received in the rotor in a manner that enables radial reciprocation of the at least one vane relative to the rotor. A radially outer end part of the at least one vane is adapted to slide along an inner peripheral wall of the housing when the rotor is rotated by the electric motor. The pressure sensor senses a pressure of the gas, which is depressurized or pressurized by the rotation of the rotor and the at least one vane. The controlling means determines whether condensed water is present at the rotor and the at least one vane based on an electric current, which flows in the electric motor upon driving of the electric motor. When the controlling means determines that the condensed water is present at the rotor and the at least one vane, the controlling means drives the electric motor for a predetermined time period. When the controlling means determines that the condensed water is absent at the rotor and the at least one vane, the controlling means stores the pressure, which is sensed through the pressure sensor after the determining of the absence of the condensed water at the rotor and the at least one vane, as a first pressure. The controlling means is adapted to sense an abnormality in a pump characteristic of the vane pump apparatus based on a value of the first pressure.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
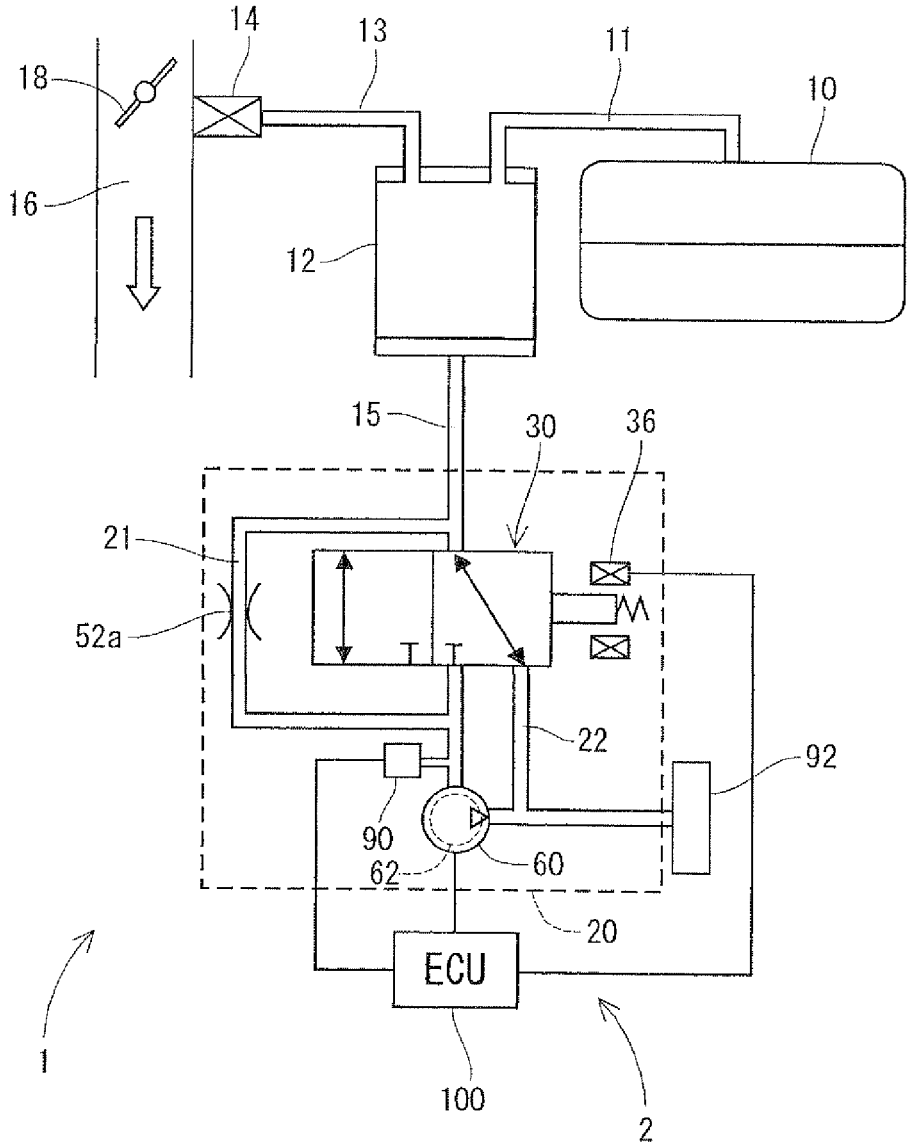
FIG. 1 is a schematic diagram showing a leak check system according to a first embodiment of the present invention.

A leak check system of various embodiments of the present invention will be described with reference to the accompanying drawings. In the following embodiments, similar components will be indicated by the same reference numerals and will not be described redundantly for the sake of simplicity.

First Embodiment

FIG. 1 shows a leak check system according to a first embodiment of the present invention.

With reference to FIG. 1, in an evaporative emission system of a vehicle (e.g., an automobile), a passage 11 connects between a fuel tank 10 and a canister 12, and a purge passage 13 connects between the canister 12 and a portion of an intake passage 16 of an internal combustion engine, which is located adjacent to a throttle valve 18 disposed in the intake passage 16. A purge valve 14 is placed in the purge passage 13. Fuel vapor (evaporated fuel), which is generated in the fuel tank 10, is conducted into an inside of the canister 12 through the passage 11 and is adsorbed by adsorbent (e.g., activated carbon) received in the canister 12. The purge valve 14 is a solenoid valve, and an opening degree of the purge valve 14 is controlled to adjust a quantity of the fuel vapor, which is purged from the canister 12 into the intake passage 16.

The leak check system 1 of the first embodiment includes a pump module 20 and an electronic control unit (ECU) 100. The ECU 100 serves as a controlling means and a determining means. The leak check system 1 is constructed to check a leakage of fuel at the evaporative emission system, which includes the fuel tank 10, the canister 12, the purge valve 14, the passage 11 and the purge passage 13 discussed above.

An atmospheric side portion of the canister 12 is connected to a change valve 30 of the pump module 20 through an atmosphere communication passage 15. The atmospheric side portion of the canister 12 is also connected to a pump 60 of the pump module 20. The pump 60 is a vane pump. A reference orifice 52*a*, which is a choked passage section having a reduced passage cross section in comparison to its upstream side and downstream side, is formed in a sensing passage 21.

The pump module 20 is a module, in which the change valve 30 and the pump 60 are integrated together. The pump module 20 and the ECU 100 form a vane pump apparatus 2. The change valve 30 of the pump module 20 is a solenoid valve, which communicates between the atmosphere communication passage 15 and an atmosphere communication passage 22 in a deenergized state of a coil 36, as shown in FIG. 1. A filter 92 is installed in an end portion of the atmosphere communication passage 22, which is opposite from the change valve 30. When the coil 36 is energized, i.e., when the electric power is supplied to the coil 36, the change valve 30 directly communicates between the canister 12 side and the pump 60 side without passing through the sensing passage 21.

Figure 2:
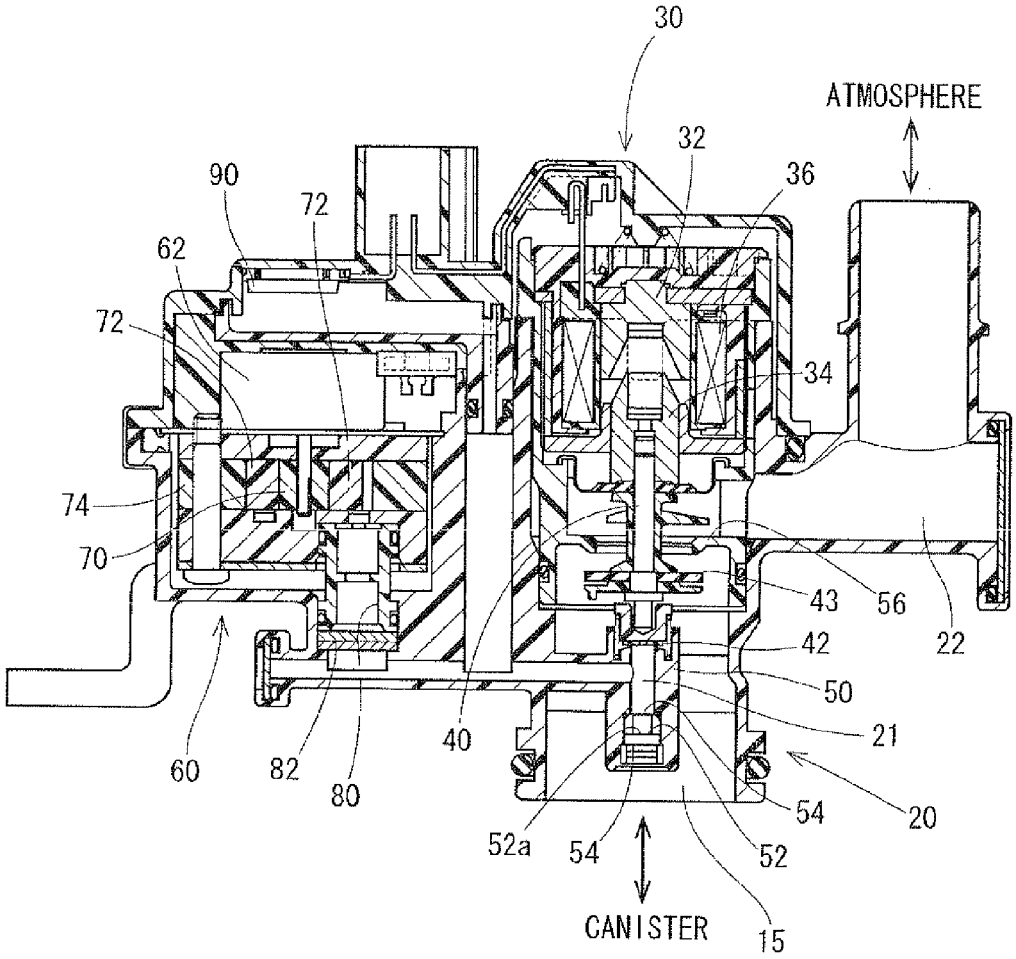
FIG. 2 is a cross-sectional view showing a pump module of a leak check system according to the first embodiment.

Next, a structure of the pump module 20 will be described with reference to FIG. 2.

The atmosphere communication passages 15, 22 and the sensing passage 21 are formed in the pump module 20. The atmosphere communication passage 15 and the sensing passage 21 are always communicated with each other. A cup member 52, which forms the reference orifice 52*a*, is installed in a canister opening 50, which forms a portion of the sensing passage 21. A size of the reference orifice 52*a* corresponds to a size of a hole, which coincides with an upper limit value (specified value) of a permissible quantity of air leakage, which contains the fuel vapor supplied from the fuel tank 10. Two filters 54 are arranged on an upstream side and a downstream side, respectively, of the reference orifice 52*a*.

The change valve 30 of the pump module 20 is the solenoid valve, as discussed above. A movable core 34 of the change valve 30 is installed to oppose a stationary core 32. A shaft 40 is installed to the movable core 34. Two valve members 42, 43, which are made of rubber, are installed to the shaft 40 such that the valve members 42, 43 are axially spaced from each other. In the deenergized state of the coil 36, as shown in FIG. 2, the valve member 42 closes the canister opening 50, and the valve member 43 opens an atmosphere opening 56. In this state, the atmosphere communication passage 15 and the atmosphere communication passage 22 are communicated with each other, and the sensing passage 21 is communicated with the atmosphere communication passage 22 through the atmosphere communication passage 15. When the energization of the coil 36 is turned on, the movable core 34 is attracted to and is thereby moved toward the stationary core 32, which is located on an upper side of the movable core 34 in FIG. 2, due to presence of a magnetic attractive force exerted between the stationary core 32 and the movable core 34. Thereby, the valve member 42 opens the canister opening 50, and the valve member 43 closes the atmosphere opening 56. In this state, the atmosphere communication passage 15 and the pump 60 are directly communicated with each other without passing through the sensing passage 21, and the communication between the atmosphere communication passage 15 and the atmosphere communication passage 22 is blocked, i.e., is disabled.

The pump 60 of the pump module 20 is the vane pump, and an electric motor 62 drives a rotor 70 to rotate the same upon energization of the electric motor 62. The rotor 70, the vane 72 and a housing 74 of the pump 60 are made of a resin material. The rotor 70 includes a plurality (four in this instance) of slits, which are arranged at generally equal intervals in a circumferential direction and extend in a radial direction. A vane 72, which is configured into a plate form, is received in each slit in a manner that permits reciprocation of the vane 72 in the radial direction. The rotor 70 is eccentrically placed in and is rotatably received in the housing 74, which is configured into an annular form. When the rotor 70, which is eccentric to the housing 74, is rotated by the motor 62, the vanes 72, which receive a radially outward force upon exertion of a centrifugal force, slide along an inner peripheral wall surface of the housing 74 and are radially reciprocated. A filter 82 is installed to a suction port 80 of the pump 60. A pressure sensor 90 senses a pressure at the suction port 80 of the pump 60. In the pump 60, which is constructed in the above described manner, when the rotor 70 is rotated while reciprocating the vanes 72 in the radial direction, the atmosphere communication passage 15 or the sensing passage 21 is depressurized.

The ECU 100 includes a CPU, a RAM, a ROM and an I/O interface. When the CPU executes a control program stored in the ROM, the ECU 100 controls a drive signal, which is outputted to the change valve 30 of the pump module 20 to drive the same, and a drive signal, which is outputted to the motor 62 to drive the same and thereby to drive the pump 60. Furthermore, the ECU 100 receives a pressure measurement signal from the pressure sensor 90.

Next, an operation of the leak check system 1 will be described with reference to FIG. 3.

Figure 3:
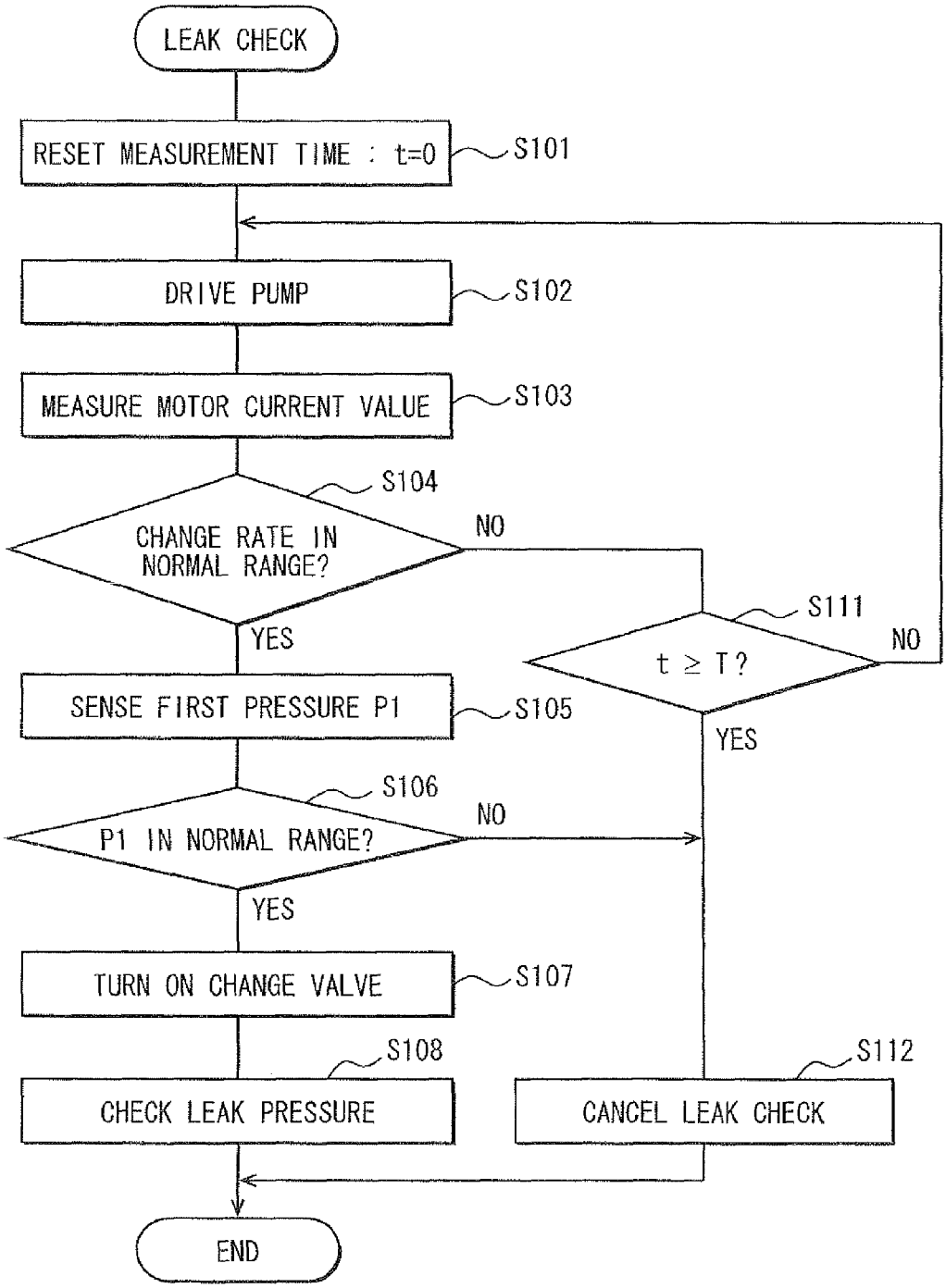
FIG. 3 is flowchart showing leak check of the leak check system according to the first embodiment.

In the present embodiment, the ECU 100 functions as the controlling means and the determining means in a routine of the leak check shown in FIG. 3. The routine of FIG. 3 is started upon termination of driving of the vehicle (e.g., upon turning off of an ignition key of the vehicle by a driver of the vehicle).

When the routine of FIG. 3 is started, the ECU 100 senses the atmospheric pressure based on the measurement signal, which is outputted from the pressure sensor 90, in the deenergized states of the change valve 30 and of the motor 62 of the pump 60. For example, in a case where the vehicle is located in a highland, and thereby the sensed pressure, which is sensed with the pressure sensor 90, is lower than a predetermined pressure, the leak check itself may not be performed. The atmospheric pressure, which is sensed with the pressure sensor 90, may be used as a correction value that is used at the time of determining the pressure value in the leak check performed thereafter.

At step S101, the ECU 100 resets a value of measurement time t to 0 (zero). Thereafter, the ECU 100 progressively increments the value of the measurement time t. When the value of the measurement time t is reset to 0 (zero), the operation proceeds to step S102.

At step S102, the ECU 100 turns on the supply of the electric power to the motor 62 to drive the pump 60 in the state of FIG. 1 where the supply of the electric power to the change valve 30 is turned off. At this time, in the present embodiment, the ECU 100 controls the rotation of the motor 62 such that a rotational speed (the number of rotations per unit time) of the motor 62 becomes generally constant.

Then, at step S103, the ECU 100 measures a value of the electric current, which flows in the motor 62.

At step S104, the ECU 100 deduce, i.e., determines whether condensed water is present at the rotor 70 and the vanes 72 based on the measured value of the electric current, which is measured at step S103. Specifically, when a rate of change in the measured value of the electric current (hereinafter simply referred to as a change rate of the measured current value) is out of a normal range, the ECU 100 deduces, i.e., determines that the condensed water is present at the rotor 70 and the vanes 72. In contrast, when the change rate of the measured current value is within the normal range, the ECU 100 deduces, i.e., determines that the condensed water is not present, i.e., is absent at the rotor 70 and the vanes 72.

Figure 4A:
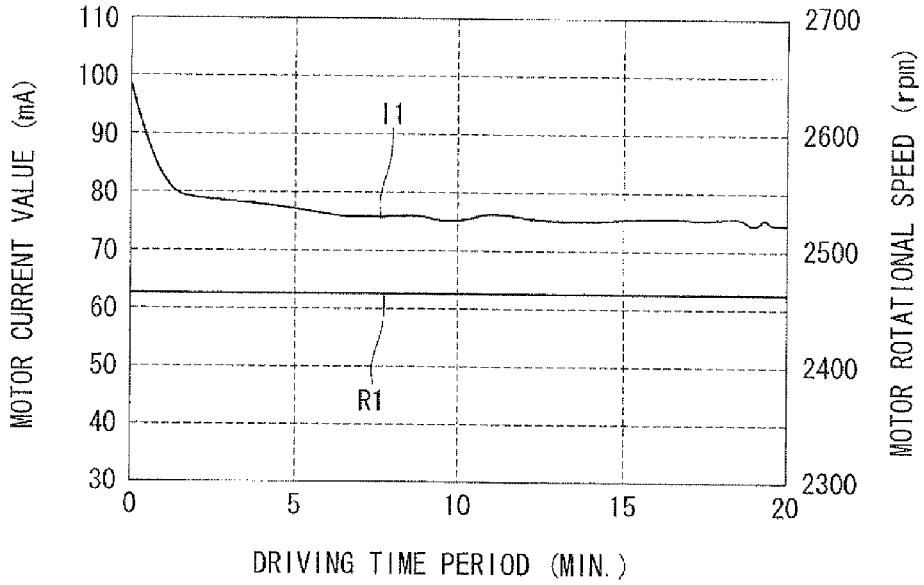
FIG. 4A is a diagram showing a change in an electric current, which flows in an electric motor of a vane pump apparatus in presence of condensed water, in a case where the electric motor is controlled to have a generally constant rotational speed.

In the state where the condensed water is present at the rotor 70 and the vanes 72, when the motor 62 is energized to begin its rotation and is controlled to achieve a generally constant rotational speed (see the rotational speed R1 shown in FIG. 4A), the change rate of the measured current value (see the current value I1 in FIG. 4A) is relatively large within a predetermined time period, which begins immediately after the starting of the driving of the motor 62.

Figure 4B:
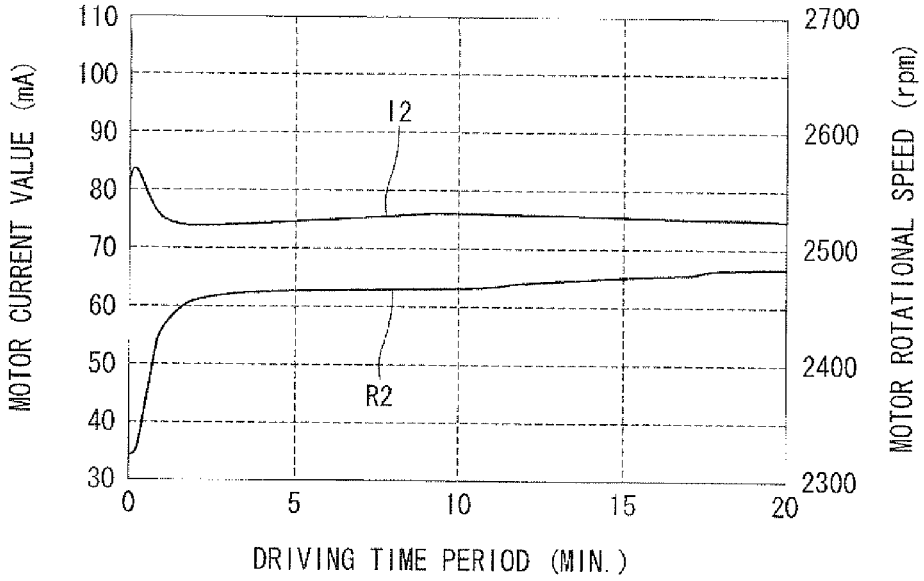
FIG. 4B is a diagram showing a change in an electric current, which flows in the electric motor of the vane pump apparatus in the presence of the condensed water, in another case where the electric motor is not controlled to have the generally constant rotational speed.

In contrast, in the state where the condensed water is present at the rotor 70 and the vanes 72, when the motor 62 is energized to begin its rotation but is not controlled for the rotational speed thereof (see the rotational speed R2 shown in FIG. 4B), the change rate of the measured current value (see the current value I2 in FIG. 4B) is relatively small in the predetermined time period, which begins immediately after the starting of the driving of the motor 62.

In the present embodiment, the motor 62 is controlled to have the generally constant rotational speed, and the current value of the electric current, which flows in the motor 62, is measured. Therefore, the temporal change in the electric current, which flows in the motor 62, becomes prominent when the condensed water is present at the rotor 70 and the vanes 72. Thereby, it is possible to accurately deduce, i.e., determine whether the condensed water is present at the rotor 70 and the vanes 72.

When it is deduced, i.e., determined that the condensed water is present at the rotor 70 and the vanes 72, i.e., when the change rate of the measured current value is out of the normal range, the operation proceeds to step S111. In contrast, when it is deduced, i.e., determined that the condensed water is not present at the rotor 70 and the vanes 72, i.e., when the change rate of the measured current value is within the normal range, the operation proceeds to step S105.

At step S105, the ECU 100 senses the pressure through the pressure sensor 90. At this time, the supply of the electric current to the change valve 30 is turned off, and the motor 62 is controlled to rotate at the generally constant rotational speed. Furthermore, the pump 60, which is rotated through the rotation of the motor 62, is communicated with the atmosphere through the sensing passage 21, the atmosphere communication passage 15, the change valve 30, the atmosphere communication passage 22 and the filter 92 (see FIG. 1). Therefore, the pressure, which is sensed with the pressure sensor 90 upon the driving of the pump 60, is a pressure, which is determined by an inner diameter of the reference orifice 52*a*. The ECU 100 stores the sensed pressure, which is sensed with the pressure sensor 90, as a first pressure P1 in its memory.

At step S106, the ECU 100 determines whether the first pressure P1, which is stored in its memory at step S105, is within a normal range. When it is determined that the first pressure P1 is within the normal range at step S106, the ECU 100 proceeds to step S107.

Figure 5A:
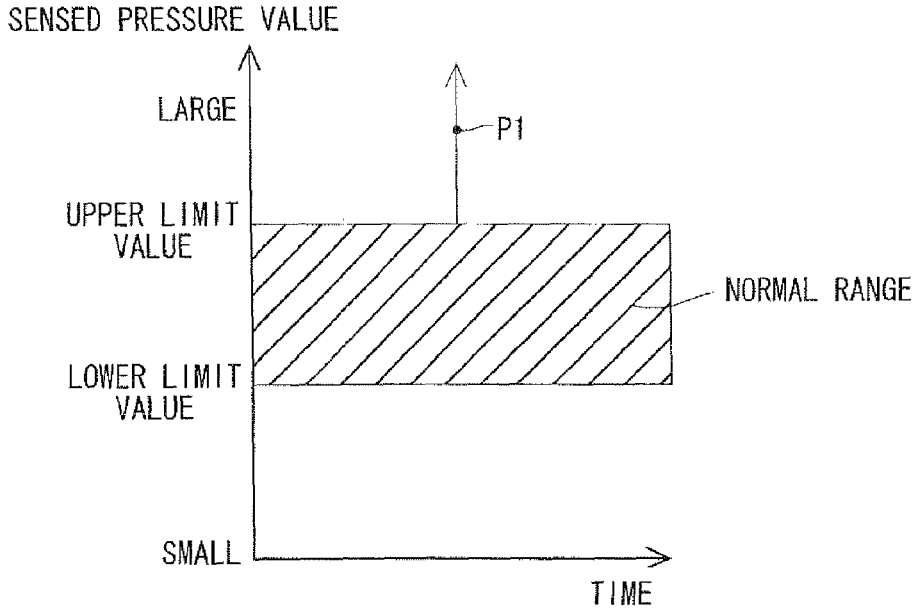
FIG. 5A is a diagram showing a sensed first pressure, which is larger than an upper limit value of a normal range.

In contrast, when it is determined that the first pressure P1 is larger than an upper limit value of the normal range (i.e., the first pressure P1 being outside of the normal range indicated in FIG. 5A) at step S106, it is assumed that the depressurizing effect of the pump 60 is deteriorated due to, for example, the sealing malfunction of the change valve 30. In such a case, a maintenance work, such as replacement of the change valve 30, is required. Therefore, the leak check is canceled at step S112, and the routine of FIG. 3 is terminated. At this time, a notification, which notifies the non-execution (unfinished state) of the leak check, and a notification, which notifies a need for the maintenance work for replacing the change valve 30, may be provided to the driver of the vehicle through a notifying means (e.g., a warning lamp).

Figure 5B:
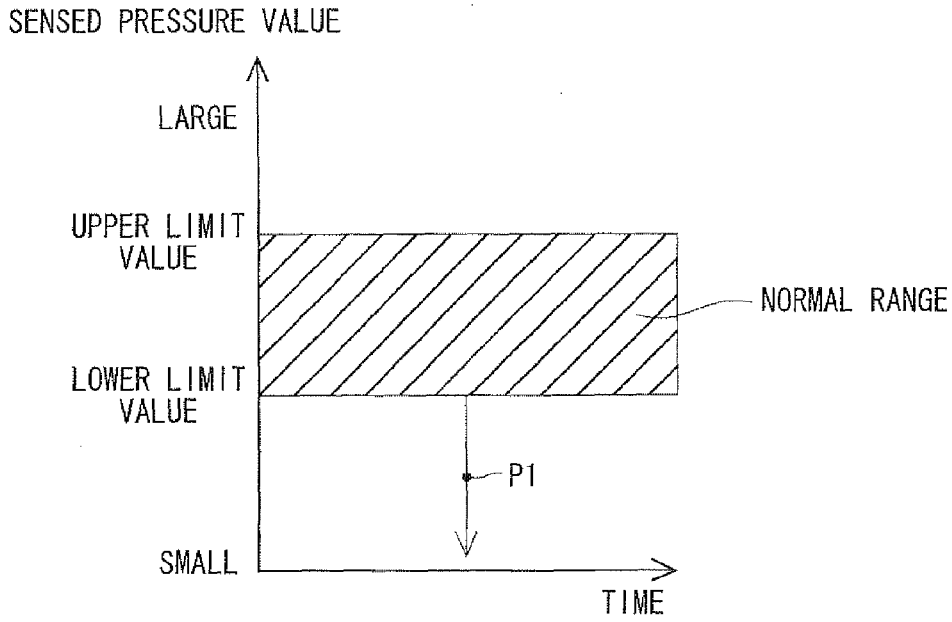
FIG. 5B is a diagram showing a sensed first pressure, which is smaller than a lower limit value of the normal range.

In a case where the first pressure P1 is smaller than a lower limit value of the normal range (i.e., the first pressure P1 being outside of the normal range, as indicated in FIG. 5B), it is assumed that the pump characteristic is changed (occurrence of an abnormality in the pump characteristic) due to, for example, accumulation of abrasion powder in the housing 74, which causes an increased degree of sealing (an increased degree of clogging). In this state, the accurate leak check may not be possible.

Therefore, at step S112, the leak check is canceled, and the routine of FIG. 3 is terminated. At this time, a notification, which notifies the non-execution of the leak check, and a notification, which notifies the accumulation of the abrasion powder in the housing 74, may be provided to the driver of the vehicle through the notifying means (e.g., the warning lamp).

At step S107, the ECU 100 turns on the supply of the electric current to the change valve 30. Thereby, the change valve 30 directly communicates between the pump 60 and the atmosphere communication passage 15 on the canister 12 side while disconnecting the communication between the atmosphere communication passage 15 and the atmosphere communication passage 22. Therefore, the evaporative emission system, which includes the fuel tank 10, the canister 12, the purge valve 14, the passage 11, the purge passage 13 and the fuel tank 10, is depressurized through the driving of the pump 60.

At step S108, the ECU 100 sets the first pressure P1, which is stored at step S105, as a reference pressure PS. At this time (at step S108), the ECU 100 determines whether a leak having a cross-sectional area, which is larger than the passage cross-sectional area of the reference orifice 52*a*, exists in the evaporative emission system by comparing the pressure, which is sensed with the pressure sensor 90, with the reference pressure PS.

Specifically, in a case where the pressure, which is sensed with the pressure sensor 90, is smaller than the reference pressure PS, the ECU 100 determines that the leak having the cross-sectional area, which is smaller than the reference orifice 52*a*, exists in the evaporative emission system.

In contrast, in a case where the pressure, which is sensed with the pressure sensor 90, is larger than the reference pressure PS, the ECU 100 determines that the leak having the cross-sectional area, which is larger than the reference orifice 52*a*, exists in the evaporative emission system. At this time, a notification, which notifies the existence of the leak equal to or larger than the predetermined size in the evaporative emission system, may be provided to the driver of the vehicle through the notifying means (e.g., the warning lamp).

When step S108 is completed, the routine of FIG. 3 is terminated. As discussed above, when it is deduced, i.e., determined that the condensed water is present at the rotor 70 and the vanes 72 at step S104, i.e., when the change rate of the measured current value is out of the normal range, the ECU 100 proceeds to step S111.

At step S111, the ECU 100 determines whether the present value of the time t is equal to or larger than a predetermined value (a value indicating an end of the predetermined time period) T. When it is determined that the present value of the time t is equal to or larger than the predetermined value T at step S111 (i.e., YES at step S111), the ECU 100 determines that the condensed water is not eliminated upon the elapse of the predetermined time period. Therefore, the ECU 100 proceeds to step S112 where the leak check is canceled, and the routine of FIG. 3 is terminated. At this time, a notification, which notifies the non-execution of the leak check, and a notification, which notifies the possibility of the presence of the condensed water at the pump 60, may be provided to the driver of the vehicle through the notifying means (e.g., the warning lamp).

In contrast, when it is determined that the present value of the time t is smaller than the predetermined value T at step S111, (i.e., NO at step S111), the ECU 100 determines that the condensed water is not yet eliminated at this time point. Thereby, the ECU 100 returns to step S102. As discussed above, when it is determined that the condensed water is present at the pump 60 (i.e., the high possibility of the presence of the condensed water at the pump 60), the ECU 100 drives the pump 6 for the predetermined time period. In this way, the condensed water will possibly be eliminated by, for example, the heat generated through the slide movement between the rotor 70 and the housing 74. Furthermore, the predetermined value T is appropriately set in view of, for example, the environment, in which the leak check system 1 is used, and the performance of the pump 60. As discussed above, the ECU 100 functions as the controlling means at steps S101-107, S111, S112 and functions as the determining means at step S108.

As discussed above, according to the present embodiment, the ECU 100 deduces, i.e., determines whether the condensed water is present at the rotor 70 and the vanes 72 (the pump 60) based on the electric current, which flows in the motor 62 at the time of driving the motor 62. In the present embodiment, it is deduced, i.e., determined whether the condensed water is present at the rotor 70 and the vanes 72 based on the temporal change in the electric current, which flows in the motor 62 at the time of driving the motor 62.

When it is deduced, i.e., determined that the condensed water is present at the rotor 70 and the vanes 72, the ECU 100 drives the motor 62 for the predetermined time period. In this way, even when the condensed water is present at the rotor 70 and the vanes 72, the condensed water can be eliminated.

In contrast, when it is deduced, i.e., determined that the condensed water is not present, i.e., is absent at the rotor 70 and the vanes 72, the ECU 100 stores the pressure, which is sensed with the pressure sensor 90 after this determination, as the first pressure P1. Then, the ECU 100 can sense the presence of the abnormality in the pump characteristic based on the value of the first pressure P1. Here, the abnormality in the pump characteristic refers to an abnormality of increasing the degree of sealing (the degree of clogging) caused by the accumulation of the abrasion powder of the rotor 70, vanes 72 and the housing 74 in the inside of the housing 74, thereby changing the pump characteristic.

As discussed above, according to the present embodiment, it is deduced, i.e., determined whether the condensed water is present at the rotor 70 and the vanes 72 based on the electric current flowing in the motor 62 before the time of sensing the abnormality in the pump characteristic based on the first pressure P1. Therefore, it is possible to deduce the presence of the condensed water in the state where the sensed pressure is within the normal range due to the improved degree of sealing with the abrasion powder. Therefore, in the present embodiment, the presence of the condensed water at the rotor 70 and the vanes 72 can be accurately deduced.

Furthermore, according to the present embodiment, at the time of driving the motor 62, the ECU 100 controls the rotation of the motor 62 such that the rotational speed of the motor 62 becomes generally constant. Therefore, the temporal change in the electric current, which flows in the motor 62, becomes prominent when the condensed water is present at the rotor 70 and the vanes 72. Thus, it is possible to deduce, i.e., determine whether the condensed water is present at the rotor 70 and the vanes 72.

Furthermore, according to the present embodiment, the ECU 100 determines the leak of the evaporative emission system by comparing the pressure, which is sensed with the pressure sensor 90, with the reference pressure PS at the time of depressurizing the evaporative emission system through the vane pump apparatus 2 only in the state where the ECU 100 deduces, i.e., determines that the condensed water is not present at the rotor 70 and the vanes 72, and the abnormality in the pump characteristic is not sensed. That is, according to the present embodiment, the leak check will not be executed in the state where it is deduced, i.e., determined that the condensed water is present at the rotor 70 and the vanes 72, or the abnormality in the pump characteristic is sensed. Thus, it is possible to avoid the execution of the leak check in the state where the condensed water or the abnormality in the pump characteristic is actually present, and thereby it is possible to avoid the erroneous determination about the leak. As a result, the reliability of the leak check system 1 can be improved.

Furthermore, according to the present embodiment, the ECU 100 sets the stored first pressure P1 as the reference pressure PS and determines the leak of the evaporative emission system based on this reference pressure PS. Accordingly, in the present embodiment, the pressure (the first pressure P1), which is sensed to deduce, i.e., determine the presence of the condensed water at the rotor 70 and the vanes 72, is used in the leak check of the evaporative emission system. Thereby, the number of steps executed by the ECU 100 can be reduced at the time of executing the leak check.

Second Embodiment

Figure 6:
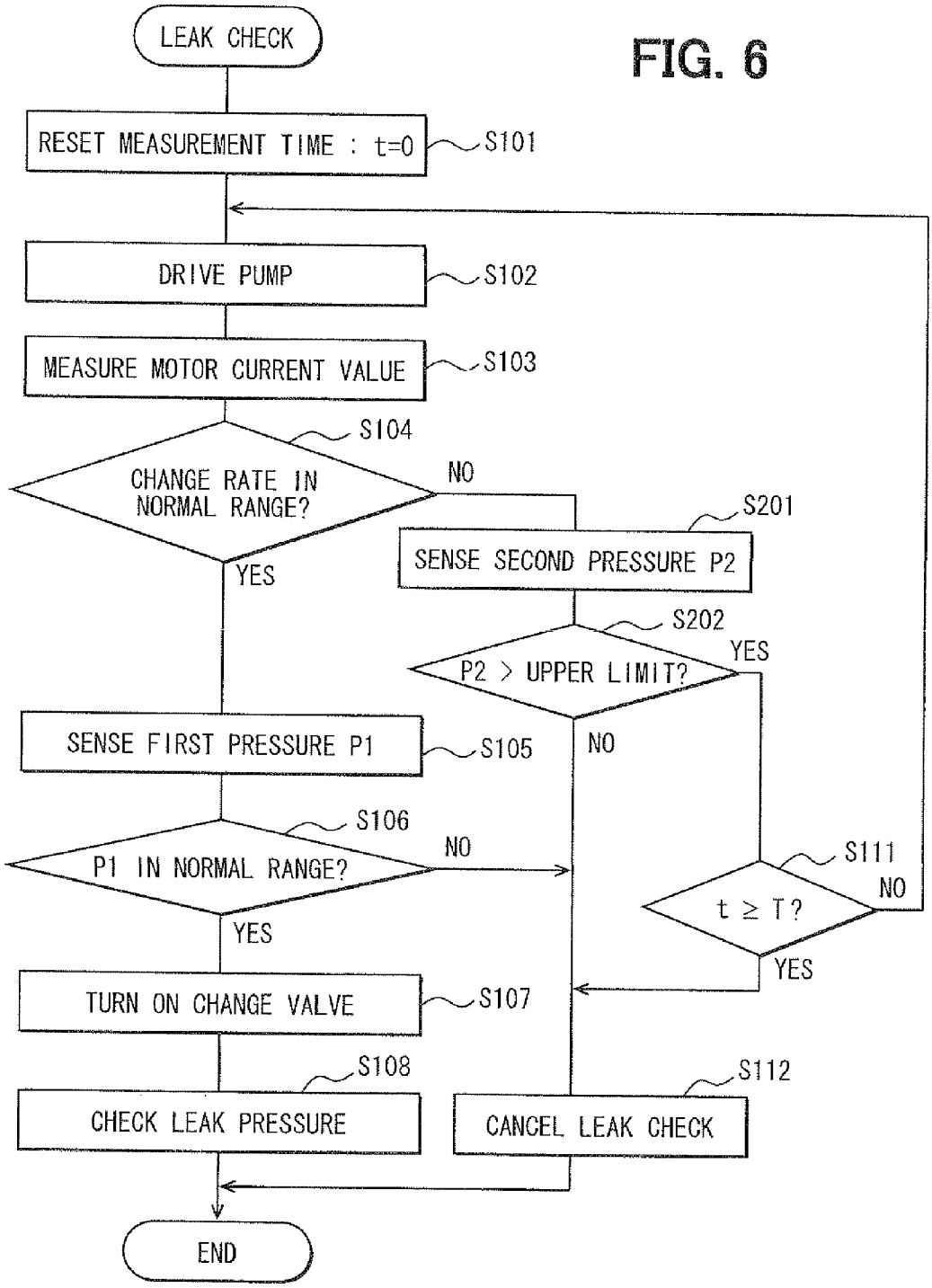
FIG. 6 is flowchart showing leak check of a leak check system according to a second embodiment of the present invention.

FIG. 6 indicates a routine of leak check executed at a leak check system according to a second embodiment of the present invention. The physical structure of the leak check system of the second embodiment is substantially the same as that of the first embodiment. However, the second embodiment differs from the first embodiment with respect to the routing of the leak check.

In the second embodiment, as shown in FIG. 6, when it is deduced, i.e., determined that the condensed water is present at the rotor 70 and the vanes 72 at step S104, i.e., when the change rate of the measured current value is out of the normal range, the ECU 100 proceeds to step S201.

At step S201, the ECU 100 senses the pressure through the pressure sensor 90. At this time, the supply of the electric current to the change valve 30 is turned off, and the motor 62 is controlled to rotate at the generally constant rotational speed. Furthermore, the pump 60, which is rotated through the rotation of the motor 62, is communicated with the atmosphere through the sensing passage 21, the atmosphere communication passage 15, the change valve 30, the atmosphere communication passage 22 and the filter 92 (see FIG. 1). Therefore, the pressure, which is sensed with the pressure sensor 90 upon the driving of the pump 60, is a pressure, which is determined by the inner diameter of the reference orifice 52*a*. The ECU 100 stores the sensed pressure, which is sensed with the pressure sensor 90 at this time, as a second pressure P2 in its memory.

At step S202, the ECU 100 determines whether the second pressure P2, which is stored in its memory at step S201, is larger than the upper limit value of the normal range.

Figure 7A:
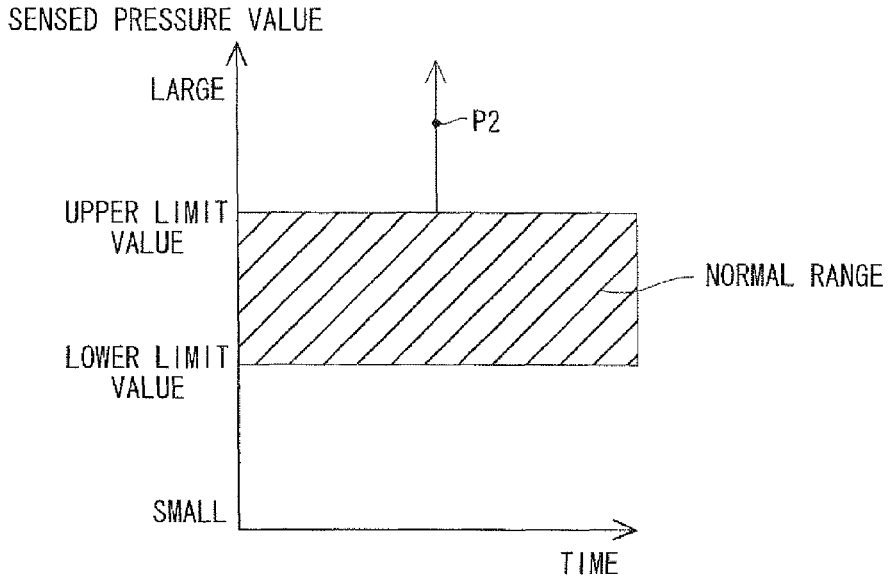
FIG. 7A is a diagram showing a sensed second pressure, which is larger than an upper limit value of a normal range.

When it is determined that the second pressure P2 is larger than the upper limit value of the normal range (i.e., the second pressure P2 being outside of the normal range indicated in FIG. 7A), it is assumed that the condensed water is present at the rotor 70 and the vanes 72 to cause the sticking of the vanes 72 to the rotor 70 and thereby to cause the reduction in the vacuum force of the pump 60. In such a case, the condensed water may possibly be eliminated by driving the pump 60 for the predetermined time period. Thereby, the operation proceeds to step S111. Step S111 of the second embodiment is similar to that of the first embodiment.

Figure 7B:
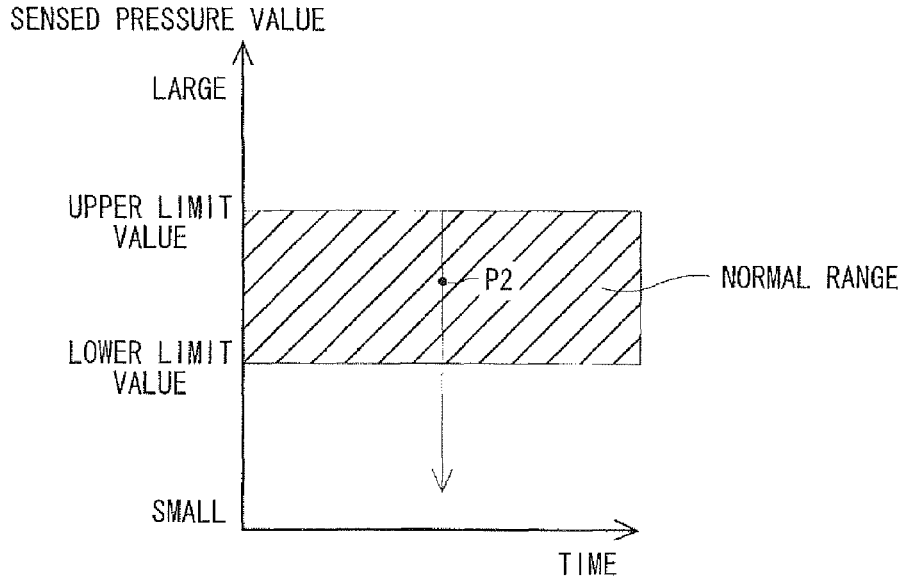
FIG. 7B is a diagram showing a sensed second pressure, which is smaller than the upper limit value of the normal range.

In contrast, in a case where the second pressure P2 is equal to or smaller than the upper limit value of the normal range (i.e., the second pressure P2 being within the normal range or being outside of the normal range, as indicated in FIG. 7B), it is assumed that the pump characteristic is changed (occurrence of an abnormality in the pump characteristic) due to, for example, accumulation of abrasion powder in the housing 74, which causes an increased degree of sealing (an increased degree of clogging). More specifically, in such a case, although the vacuum force of the pump 60 is reduced due to the presence of the condensed water, the degree of sealing is increased due to the accumulation of the abrasion powder, and thereby the vacuum force of the pump 60 becomes equal to or higher than the normal value. Thus, the pressure, which is sensed with the pressure sensor 90, becomes equal to or smaller than the upper limit value of the normal range. In this state, the accurate leak check may not be possible. Therefore, at step S112, the leak check is canceled, and the routine of FIG. 6 is terminated. At this time, a notification, which notifies the non-execution of the leak check, and a notification, which notifies the presence of the condensed water in the housing 74 and accumulation of the abrasion powder in the housing 74, may be provided to the driver of the vehicle through the notifying means (e.g., the warning lamp).

The remaining steps (i.e., steps S101-S108, S111 and S112) of FIG. 6, which are other steps S201 and S202, are similar to those of the first embodiment.

As discussed above, when it is deduced, i.e., determined that the condensed water is not present at the rotor 70 and the vanes 72, the ECU 100 stores the pressure, which is sensed with the pressure sensor 90 after this determination, as the second pressure P2. Then, the ECU 100 can sense the presence of the abnormality in the pump characteristic based on the value of the second pressure P2. Here, for example, in the case where the second pressure P2 is equal to or smaller than the upper limit value of the normal range, it is possible to determine that the abrasion powder is accumulated in the housing 74, i.e., it is possible to determine that the accumulated abrasion powder in the housing 74 improves the degree of sealing to cause the abnormality of changing the pump characteristic. As discussed above, according to the present embodiment, after it is deduced, determined that the condensed water is present, the abnormality of the pump 60 can be determined.

Furthermore, according to the present embodiment, at the time of sensing the pressure (the second pressure P2) with the pressure sensor 90, the motor 62 is controlled to rotate at generally the constant rotational speed. Thereby, it is possible to limit the change in the pressure. In this way, the abnormality in the pump characteristic can be accurately sensed.

Now, modifications of the above embodiments will be described.

In the above embodiments, in the routine of the leak check, the ECU controls the motor to rotate at the generally constant rotational speed. Alternatively, in a modification of the above embodiments, in the routine of the leak check, the ECU does not control the motor to rotate at the generally constant rotational speed.

Furthermore, in the above embodiment, it is deduced, i.e., determined whether the condensed water is present at the rotor and the vanes based on the temporal change in the electric current, which flows in the motor, at the time of driving the motor. Alternatively, in a modification of the above embodiments, it may be determined whether the condensed water is present at the rotor and the vanes based on a result of determination of whether the value of the electric current, which flows in the motor, at the time of driving the motor, is within a normal range. For example, in the case where the measured value of the electric current is larger than the normal range and is substantially deviated from the normal range, it is deduced that this is caused by a large load applied to the motor due to presence of a surface tension generated by the condensed water at the location between the rotor and the housing.

Furthermore, in the above embodiments, the ECU sets the first pressure P1, which is previously stored in the memory of the ECU, as the reference pressure PS and determines the leak of the evaporative emission system based on the reference pressure PS at step (step S108) of the leak pressure check. Alternatively, in a modification of the above embodiments, the reference pressure PS may be directly sensed with a pressure sensor without setting the stored first pressure P1 as the reference pressure PS at step (S108) of the leak pressure check.

Furthermore, in the above embodiments, the vane pump apparatus of the present invention is applied to the leak check system. Alternatively, in a modification of the above embodiments, the vane pump apparatus of the present invention may be applied to any other type of system as long as a pump apparatus of such a system is a vane pump apparatus, which depressurizes or pressurize gas.

Furthermore, in the case where the vane pump apparatus of the present invention is used in the leak check system, such as the one discussed in the above embodiments, the leak check may be performed by pressurizing the evaporative emission system.

Additional advantages and modifications will readily occur to those skilled in the art. The invention in its broader terms is therefore not limited to the specific details, representative apparatus, and illustrative examples shown and described.

What is claimed is:

1. A vane pump apparatus, which is adapted to depressurize or pressurize gas, the vane pump apparatus comprising:

a housing;

a rotor that is rotatably received in and is eccentric to the housing;

an electric motor that drives the rotor upon energization of the electric motor;

at least one vane that is received in the rotor in a manner that enables radial reciprocation of the at least one vane relative to the rotor, wherein a radially outer end part of the at least one vane is adapted to slide along an inner peripheral wall of the housing when the rotor is rotated by the electric motor;

a pressure sensor that senses a pressure of the gas, which is depressurized or pressurized by the rotation of the rotor and the at least one vane; and means for controlling the rotation of the electric motor, wherein:

the controlling means determines whether condensed water is present at the rotor and the at least one vane based only on an electric current, which flows in the electric motor upon driving of the electric motor;

when the controlling means determines that the condensed water is present at the rotor and the at least one vane, the controlling means drives the electric motor for a predetermined time period;

when the controlling means determines that the condensed water is absent at the rotor and the at least one vane, the controlling means stores the pressure, which is sensed through the pressure sensor after the determining of the absence of the condensed water at the rotor and the at least one vane, as a first pressure; and the controlling means is adapted to sense an abnormality in a pump characteristic of the vane pump apparatus based on a value of the first pressure.

2. The vane pump apparatus according to claim 1, wherein:

when the controlling means determines that the condensed water is present at the rotor and the at least one vane, the controlling means stores the pressure, which is sensed through the pressure sensor after the determining of the presence of the condensed water at the rotor and the at least one vane, as a second pressure; and the controlling means is adapted to sense the abnormality in the pump characteristic based on the second pressure.

3. The vane pump apparatus according to claim 1, wherein when the controlling means drives the electric motor, the controlling means controls the rotation of the electric motor such that the electric motor is rotated at a generally constant rotational speed.

4. The vane pump apparatus according to claim 3, wherein:

when a change rate in the electric current, which flows in the electric motor, is relatively large and is thereby out of a normal range in a predetermined time period, which starts immediately after starting of the driving of the electric motor, the controlling means determines that the condensed water is present at the rotor and the at least one vane; and when the change rate in the electric current, which flows in the electric motor, is relatively small and is thereby within the normal range in the predetermined time period, which starts immediately after the starting of the driving of the electric motor, the controlling means determines that the condensed water is absent at the rotor and the at least one vane.

5. A leak check system for an evaporative emission system that is adapted to purge fuel vapor generated in a fuel tank into an intake passage of an internal combustion engine, the leak check system comprising:

the vane pump apparatus of claim 1;

a passage that includes a reference orifice, which is adapted to generate a reference pressure that is used to sense a leak of the evaporative emission system when the passage conducts the gas, which is to be drawn into the vane pump apparatus or which is discharged from the vane pump apparatus; and means for determining the leak of the evaporative emission system by comparing the pressure, which is sensed through the pressure sensor, with the reference pressure at the time of depressurizing or pressurizing the evaporative emission system by the vane pump apparatus only upon satisfaction of the following conditions:

the controlling means determines that the condensed water is absent at the rotor and the at least one vane; and the controlling means does not sense the abnormality in the pump characteristic.

6. The leak check system according to claim 5, wherein:

the determining means sets the first pressure, which is prestored in the controlling means, as the reference pressure; and the determining means determines the leak of the evaporative emission system based on the reference pressure.

7. A vane pump apparatus, which is adapted to depressurize or pressurize gas, the vane pump apparatus comprising:

a housing;

a rotor that is rotatably received in and is eccentric to the housing;

an electric motor configured to drive the rotor upon energization of the electric motor;

at least one vane that is received in the rotor in a manner to enable radial reciprocation of the at least one vane relative to the rotor, wherein a radially outer end part of the at least one vane is adapted to slide along an inner peripheral wall of the housing when the rotor is rotated by the electric motor;

a pressure sensor configured to sense a pressure of the gas, which is depressurized or pressurized by the rotation of the rotor and the at least one vane; and a control device configured to control the rotation of the electric motor, wherein:

the control device configured to determine whether condensed water is present at the rotor and the at least one vane based only on an electric current, which flows in the electric motor upon driving of the electric motor;

when the control device determines that the condensed water is present at the rotor and the at least one vane, the control device configured to drive the electric motor for a predetermined time period;

when the control device determines that the condensed water is absent at the rotor and the at least one vane, the control device is configured to store the pressure, which is sensed through the pressure sensor after the determining of the absence of the condensed water at the rotor and the at least one vane, as a first pressure; and the control device is configured to sense an abnormality in a pump characteristic of the vane pump apparatus based on a value of the first pressure.

8. The vane pump apparatus according to claim 7, wherein:

when the control device determines that the condensed water is present at the rotor and the at least one vane, the control device is configured to store the pressure, which is sensed through the pressure sensor after the determining of the presence of the condensed water at the rotor and the at least one vane, as a second pressure; and the control device is configured to sense the abnormality in the pump characteristic based on the second pressure.

9. The vane pump apparatus according to claim 7, wherein when the control device drives the electric motor, the control device is configured to control the rotation of the electric motor such that the electric motor is rotated at a generally constant rotational speed.

10. The vane pump apparatus according to claim 9, wherein:

when a change rate in the electric current, which flows in the electric motor, is relatively large and is thereby out of a normal range in a predetermined time period, which starts immediately after starting of the driving of the electric motor, the control device is configured to determine that the condensed water is present at the rotor and the at least one vane; and when the change rate in the electric current, which flows in the electric motor, is relatively small and is thereby within the normal range in the predetermined time period, which starts immediately after the starting of the driving of the electric motor, the control device is configured to determine that the condensed water is absent at the rotor and the at least one vane.

11. A leak check system for an evaporative emission system that is adapted to purge fuel vapor generated in a fuel tank into an intake passage of an internal combustion engine, the leak check system comprising:

the vane pump apparatus of claim 7; and a passage that includes a reference orifice, which is configured to generate a reference pressure that is used to sense a leak of the evaporative emission system when the passage conducts the gas, which is to be drawn into the vane pump apparatus or which is discharged from the vane pump apparatus, wherein the control device is configured to determine the leak of the evaporative emission system by comparing the pressure, which is sensed through the pressure sensor, with the reference pressure at the time of depressurizing or pressurizing the evaporative emission system by the vane pump apparatus only upon satisfaction of the following conditions:

the control device is configured to determine that the condensed water is absent at the rotor and the at least one vane; and the control device is configured to not sense the abnormality in the pump characteristic.

12. The leak check system according to claim 11, wherein:

the control device is configured to set the first pressure, which is prestored in the control device, as the reference pressure; and the control device is configured to determine the leak of the evaporative emission system based on the reference pressure.

* * * * *